United States Patent [19]

Sakutori

[11] 4,399,666

[45] Aug. 23, 1983

[54] REFRIGERATOR COLD AIR RETAINING DEVICE

[76] Inventor: Eric M. Sakutori, 381 Waiehu Beach Rd., Wailuku, Hi. 96793

[21] Appl. No.: 319,739

[22] Filed: Nov. 9, 1981

[51] Int. Cl.[3] ..... F25D 23/02

[52] U.S. Cl. ..... 62/265; 312/214; 312/236; 220/85 B

[58] Field of Search ..... 62/265, 266; 220/85 B; 312/214, 236

[56] References Cited

U.S. PATENT DOCUMENTS 940,416 11/1909 Young ..... 62/265

1,953,836 4/1934 Stevens et al. ..... 62/265

FOREIGN PATENT DOCUMENTS 971473 1/1959 Fed. Rep. of Germany ..... 62/265

*Primary Examiner*—Ronald C. Capossela

*Attorney, Agent, or Firm*—Robert S. Smith

[57] ABSTRACT

Apparatus for cooperation with an upright freezer or refrigerator, having an interior chamber with an opening and a door for closing the opening, includes a flexible generally planar pie shaped cold air retainer having first and second generally rectilinear sides converging to an apex and a generally arcuate third side and means for securing the retainer to the opening and the door of the associated freezer or refrigerator with the generally planar surface disposed in substantially horizontal relationship.

5 Claims, 3 Drawing Figures

REFRIGERATOR COLD AIR RETAINING DEVICE

BACKGROUND OF THE INVENTION

The invention relates to energy saving devices and more particularly to apparatus for reducing movement of cold air out of a refrigerator. Refrigerators used in domestic as well as many commercial applications are designed with hinges along a vertical edge of a door. Similarly, many freezers of the upright style have the same door arrangement. The opening of the refrigerator or freezer door, even for brief periods, results in large quantities of relatively dense cold air flowing out of the refrigerator or freezer and down toward the floor. The waste is particularly apparent to anyone standing with bare feet adjacent to the open door.

This waste is most severe when the door is carelessly held open for long periods by children or by others. Chest type freezers avoid the problem, but the reduced accessibility of the interior storage space substantially deters customer acceptance.

It is an object of the invention to provided apparatus which will reduce the flow of cold air out of a conventional upright refrigerator or freezer.

It is another object of the invention to provide a construction which is suitable for installation either at a factory, where a refrigerator is made, or at some later time.

Another object of the invention is to provide apparatus which is adjustable to cooperate with refrigerators of various sizes.

Still another object of the invention is to provide apparatus which is simple and inexpensive to manufacture.

SUMMARY OF THE INVENTION

The foregoing objects and other objects and advantages which shall become apparent from the detailed description of the preferred embodiment are attained in an apparatus for cooperation with an upright freezer or refrigerator, having an interior chamber with an opening and a door for closing the opening, which includes a flexible generally planar pie shaped cold air retainer having first and second generally rectilinear sides converging to an apex and a generally arcuate third side. Means is provided for securing the retainer to the opening and the door of the associated freezer or refrigerator with the generally planar surface disposed in substantially horizontal relationship.

In some forms of the invention an upstanding peripheral flange is disposed about the arcuate side of the retainer. The apparatus may further include a plurality of pleats in the retainer which extend generally radially from the apex. Upstanding flanges may extend about at least the first generally rectilinear side and in some cases also along the second generally rectilinear side.

BRIEF DESCRIPTION OF THE DRAWING

The invention will be better understood by reference to the accompanying drawing in which.

DESCRIPTION OF THE PREFERRED EMBODIMENT

Figure 1:
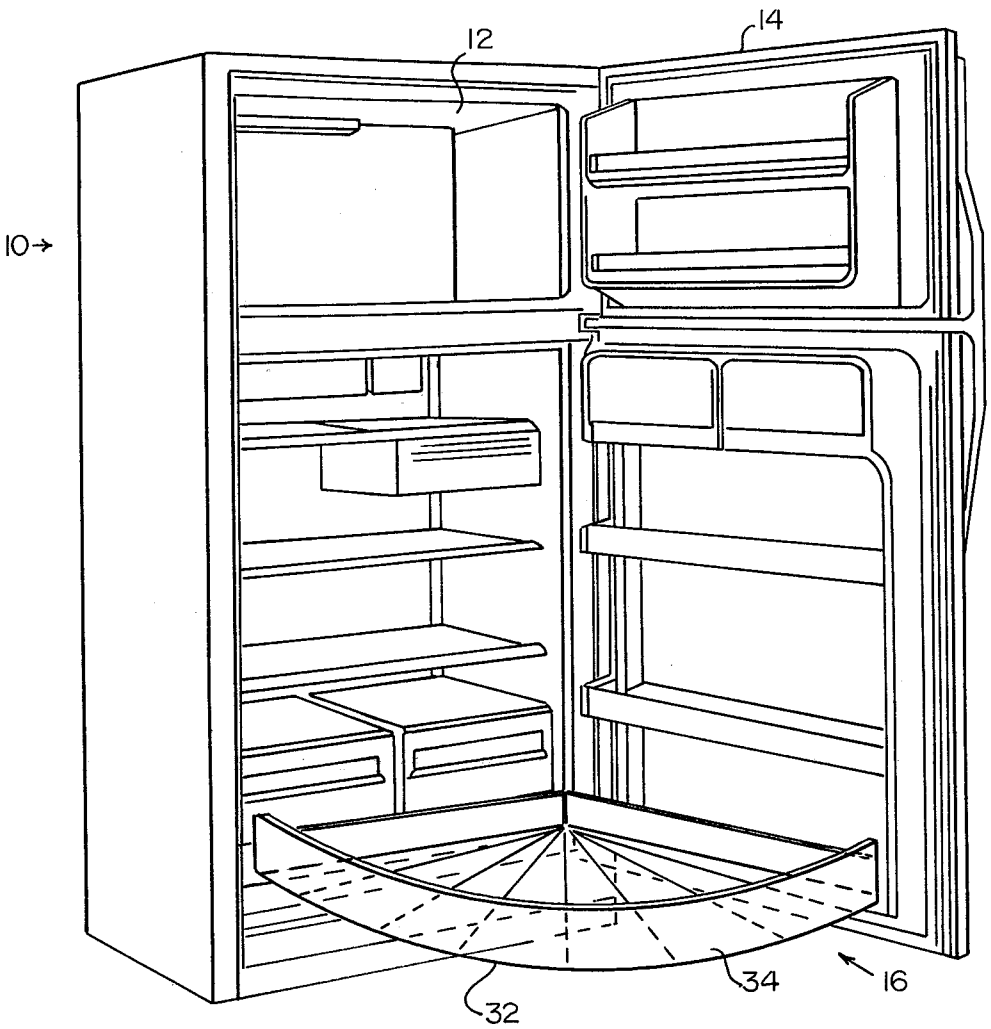
FIG. 1 is a perspective view of a refrigerator having the door open and the retainer apparatus, in accordance with the invention, mounted intermediate the bottom half of the door and the opening into the interior of the refrigerator.
Figure 2:
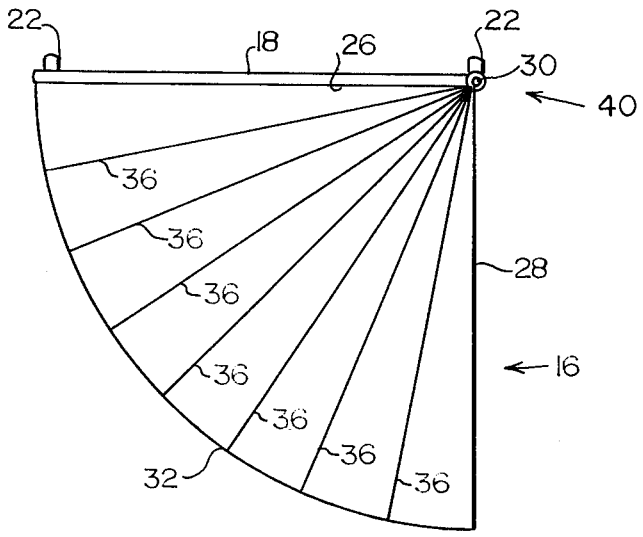
FIG. 2 is a plan view of the retainer apparatus illustrated in FIG. 1.
Figure 3:
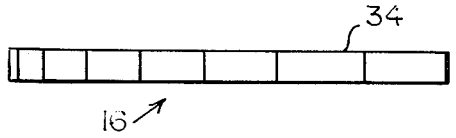
FIG. 3 is an elevational view of the retainer apparatus illustrated in FIG. 1.

Referring now to FIGS. 1, 2 and 3 there is shown a refrigerator 10 having an interior chamber 12 and a door 14.

A retainer assembly 16 is mounted intermediate the door 14 and the lower extremity of the interior chamber 12 of the refrigerator 10. The retainer assembly 16 includes a rod 18 which ordinarily is telescoping and has rubber tips 22 at the axial extremities thereof and is used to provide secure engagement between the rest of the retainer assembly 16 and the interior chamber 12 of the refrigerator 10. An internal spring (not shown) or other mechanism is provided, similar to that used in shower curtain rods and certain curtain rods, so as to maintain the axial extremities of the rod 18 against the walls of the interior chamber 12.

In some refrigerators there will be sufficient room for the rod 18 below the vegetable bins. In other refrigerators it may be desirable to mount the retainer assembly 16 with an adhesive tape or hook and eye fastener such as that sold under the Trademark VELCRO.

The retainer assembly 16 is generally pie shaped. In other words, it has two generally rectilinear sides 26, 28 which converge to an apex 30 and a third generally arcuate side 32. Disposed at least along the generally arcuate side 32 is an upstanding flange 34. The pie shaped assembly 16 is provided with a plurality of pleats 36 which extend intermediate the apex 30 and the arcuate side 32 in radial relationship to the apex 30. In some embodiments of the invention upstanding flanges 26A, 28A may be disposed along the rectilinear sides 26, 28 particularly for those applications where the inside face of the door 14 is irregular, or the inside face of the interior chamber 12 is not a vertical planar surface.

In operation the opening of the door automatically opens each of the pleats in the retainer assembly 16 and provides a "floor" which prevents passage of cold air directly out of the interior of the refrigerator 10. Since the natural flow of the relatively dense air out of the refrigerator 10 is downward, positioning of the retainer assembly 16 essentially provides a receiver into which the cold air from the interior of the refrigerator will settle. Reclosing the door automatically refolds the pleats 36 and forces the accumulated cold air back into the refrigerator interior 12.

The retainer assembly 16 is preferably manufactured of rip stop nylon. The material chosen must be supple enough so that the proper folding and unfolding of the pleats 36 will occur even when the material is relatively cold after sitting in the refrigerator or freezer for extended periods of time. A few plastics, such as some vinyls, may also be satisfactory for this purpose. It is preferred that the material is sufficiently rigid so that the retainer assembly 16 will not droop as the door 14 is moved toward the closed position. In some embodiments of the invention, a reinforcing assembly 40 may be supplied. The assembly 40 is similar to a construction commonly used in tie racks which has a plurality of radially extending arms which are movable about a vertical axis. An arm (not visible) is disposed in each pleat 36. The vertical shaft is disposed proximate to the apex 30 of the retainer assembly 16 and secured to the interior 12 of the refrigerator 10 may have each arm engaging a discrete pleat. Thus the retainer 16 will be maintained in generally hroizontal relation in all positions of the door 14.

Having thus described my invention, I claim:

1. An apparatus for cooperation with an upright freezer or refrigerator, having an interior chamber with a frame defining an opening and a door for closing the opening, which comprises:

a flexible imperforate generally planar pie shaped cold air retainer having first and second generally rectilinear sides converging to an apex and a generally arcuate third side;

means for securing said retainer to said frame and the door of the associated freezer or refrigerator with said generally planar surface disposed in substantially horizontal relationship; and said apparatus further including an upstanding peripheral flange disposed about said arcuate side of said retainer.

2. The apparatus as described in claim 1, wherein:

said apparatus further includes a plurality of pleats in said retainer which extend generally radially from said apex.

3. The apparatus as described in claims 2 wherein:

said apparatus further includes upstanding flanges extending about at least said first generally rectilinear side.

4. The apparatus as described in claims 2 or 3, wherein:

said apparatus further includes an upstanding flange extending along said second generally rectilinear side.

5. The apparatus as described in claim 2, wherein said apparatus further includes:

means for maintaining said retainer in generally horizontal relation.

* * * * *